US007502671B2

(12) United States Patent
Wilms

(10) Patent No.: US 7,502,671 B2
(45) Date of Patent: Mar. 10, 2009

(54) RAILWAY SYSTEM AND A METHOD FOR FORWARDING DATA IN A RAILWAY SYSTEM

(75) Inventor: Gerhard Wilms, Braunschweig (DE)

(73) Assignee: Siemens Aktiengesellschaft, München (DE)

( * ) Notice: Subject to any disclaimer, the term of this patent is extended or adjusted under 35 U.S.C. 154(b) by 482 days.

(21) Appl. No.: 11/247,579

(22) Filed: Oct. 11, 2005

(65) Prior Publication Data

US 2007/0032925 A1 Feb. 8, 2007

(30) Foreign Application Priority Data

Aug. 3, 2005 (DE) ..... 10 2005 037 801

(51) Int. Cl.
*B61L 3/00* (2006.01)

(52) U.S. Cl. ..... 701/19; 340/993

(58) Field of Classification Search ..... 701/19, 701/117; 340/993; 246/27, 28 R, 41, 28 F, 246/122 R See application file for complete search history.

(56) References Cited

U.S. PATENT DOCUMENTS 4,498,650 A * 2/1985 Smith et al. ..... 246/122 R
5,271,584 A 12/1993 Hochman et al.
5,330,135 A * 7/1994 Roberts ..... 246/34 R
5,769,364 A * 6/1998 Cipollone ..... 246/34 B
6,604,031 B2 * 8/2003 Oguma et al. ..... 701/19

* cited by examiner

*Primary Examiner*—Dalena Tran
(74) *Attorney, Agent, or Firm*—Henry M. Feiereisen; Ursula B. Day

(57) ABSTRACT

A railway system and a method for forwarding data in a railway system are described. Railway signaling devices are arranged near the rails. Other devices associated with the railway signaling devices each have a unique identifier, with two adjacent devices exchanging signals with one another via the rails. To transmit information in addition to the data for safely controlling the railway signaling devices without reducing the transmission capacity for the data for the safe control, a portion of the data can include the identifier of the origination device, the information and the identifier of the target device. When these data are forwarded, a first device transmits the data to the immediately following second device in the direction of the target device. The second device receives and stores the data, and returns the data to the first device, which then compares the returned data with the initially transmitted data and acknowledges to the second device the identity between the data.

7 Claims, 2 Drawing Sheets

RAILWAY SYSTEM AND A METHOD FOR FORWARDING DATA IN A RAILWAY SYSTEM

CROSS-REFERENCES TO RELATED APPLICATIONS

This application claims the priority of German Patent Application, Serial No. 10 2005 037 801.3, filed Aug. 3, 2005, pursuant to 35 U.S.C. 119(a)-(d), the subject matter of which is/are incorporated herein by reference.

BACKGROUND OF THE INVENTION

The present invention relates to a railway system and a method for forwarding data in a railway system.

Nothing in the following discussion of the state of the art is to be construed as an admission of prior art.

Railway systems with track-bound vehicles moving on tracks are known. The tracks are typically formed of two rails, with railway signals for controlling movement of the railway cars typically arranged proximate to the tracks. Associated with the railway signals are safety devices which exchange data with each other, whereby the data are exchanged bidirectionally over both rails of the track. For data exchange, digital electrical signals in form of signal pulses, in particular electrical current pulses, are transmitted over the two electrically conducting rails. This principle is also referred to as bidirectional encoded track circuit. Each of the data consists of one or more current pulses transmitted within a cycle time, which is divided into predetermined time intervals.

The data are exchanged between corresponding to immediately adjacent safety devices in temporally alternating sequential transmit and receive cycles.

If the track is disrupted or faulty, the supervisory safety devices send a general error or maintenance message, which is forwarded in the aforedescribed manner to all safety devices of the railway system.

It would be desirable and advantageous to provide an improved system and method for transmitting additional data in addition to the data that safely control the railway signaling devices, which obviates prior art shortcomings and is able to specifically transmit the additional data without adversely affecting the transmission for the control data.

SUMMARY OF THE INVENTION

According to one aspect of the present invention, a railway system with at least one track having at least two rails includes a plurality of railway signaling devices for controlling track-bound vehicles moving along the rails and a plurality of associated safety devices which each have a unique identifier. Two directly adjacent safety devices exchange bidirectionally data via the rails, wherein the data are exchanged sequentially step-by-step in alternating transmit and receive cycles. A portion of the data includes an identifier of the originating safety device, useful information, and an identifier of the destination safety device. When the data are forwarded, a respective first safety device transmits the data to a directly following second safety device arranged in the direction of the destination safety device, with the second safety device receiving the data, storing the data and returning the data to the first safety device. The first safety device compares the returned data with the originally transmitted data and confirms to the second safety device agreement between the originally transmitted and the returned data.

According to another aspect of the invention, in a railway system with at least one track with at least two rails, a plurality of railway signaling devices for controlling track-bound vehicles moving along the rails, and a plurality of associated safety devices and each having a unique identifier, a method includes the steps of the safety devices exchanging data bidirectionally data via the rails, wherein the data are exchanged sequentially step-by-step in alternating transmit and receive cycles, with a portion of the data including an identifier of the originating safety device, useful information, and an identifier of the destination safety device, forwarding the data by having a respective first safety device transmit the data to a directly following second safety device arranged in the direction of the destination safety device, the second safety device receiving the data, storing the data and returning the data to the first safety device, and the first safety device comparing the returned data with the originally transmitted data and confirming to the second safety device agreement between the originally transmitted and the returned data.

According to another feature of the present invention, the data can include message data, in particular fault messages, or command data, or both, and the useful information can be included in the data as a message code or a command code.

According to another feature of the present invention, the first safety device can confirm the agreement between the originally transmitted and returned message data or command data, or both, by ceasing transmission of the message data or command data.

According to another feature of the present invention, the system can include a memory stack associated with the respective safety device for buffering the message data or command data.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
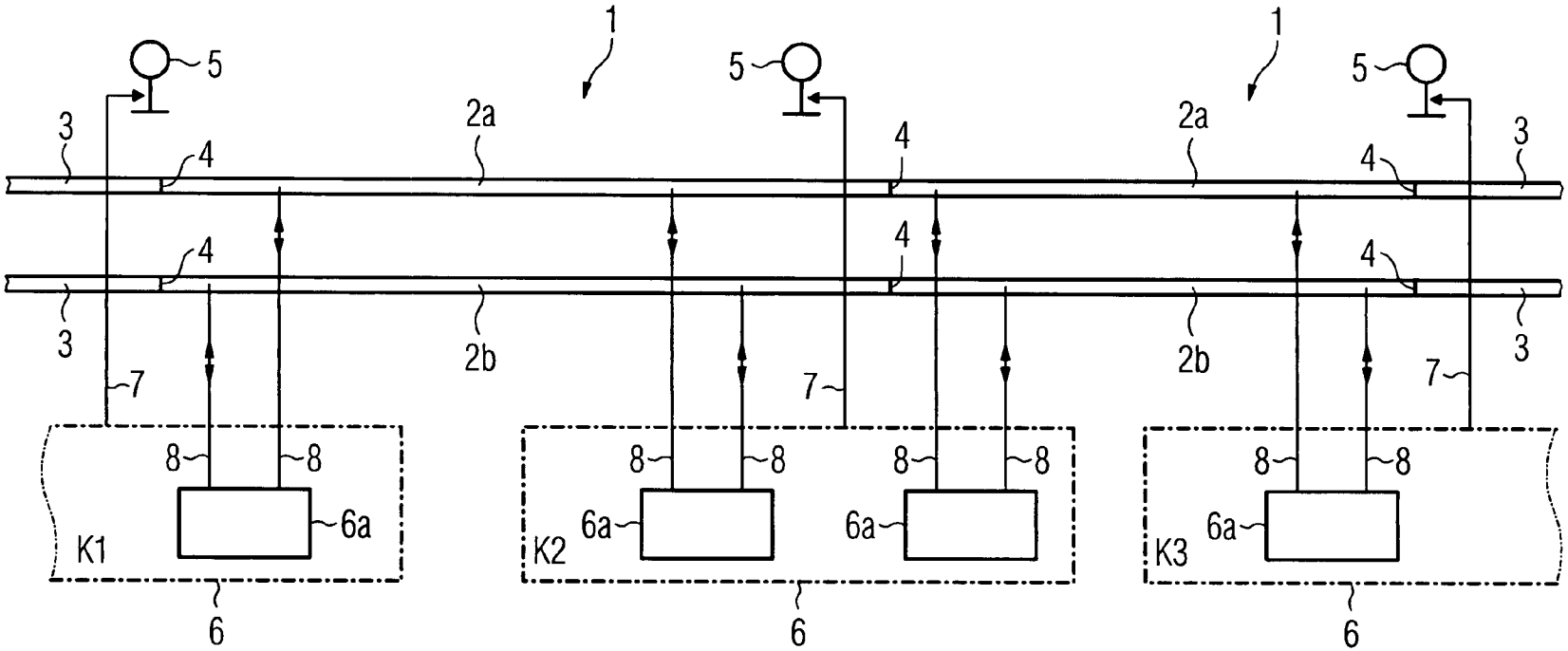
FIG. 1 shows a schematic illustration of two directly adjacent track sections of a railway system.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of an exemplary railway system according to the present invention with two directly adjacent track sections 11, 12, wherein each of the track sections 11, 12 includes two rails 2*a*, 2*b*. The two rails 2*a*, 2*b* of track sections 11, 12 are electrically insulated from rails 3 of the continuous track by insulators 4 (insulation joints). Disposed in the area of each of the insulators 4 are corresponding railway signaling systems 51, 52, 53 which control track-bound vehicles traveling along the rails 2*a*, 2*b*, 3.

The railway signaling systems 51, 52, 53 are controlled to corresponding devices 61, 62, 63, such as supervisory safety devices. Each safety device 61, 62, 63 is associated with a corresponding railway signaling device 51, 52, 53 and has a unique identification K (K1, K2, K3, K4). Each device 61, 62, 63 includes two safety devices 61*a* (not shown), 61*b*, 62*a*, 62*b*, 63*a*, 63*b* (not shown), which are each electrically connected with the corresponding rails 2*a*, 2*b* by lines 8. The safety devices 61*a*, 61*b*, 62*a*, 62*b*, 63*a*, 63*b* can transmit electrical signals as signal pulses in the form of current pulses, which are encoded as logical signal states, from, for example, device 61 of the track section 11 to adjacent device 62. The safety devices 61*a*, 61*b*, 62*a*, 62*b*, 63*a*, 63*b* include transmitters and receivers (not shown), whereby transmit and receive cycles are transmitted sequentially in an alternating fashion.

The supervisory devices 61, 62, 63 are connected to the corresponding railway signaling devices 51, 52, 53 by a corresponding electrical connection 7.

Figure 2:
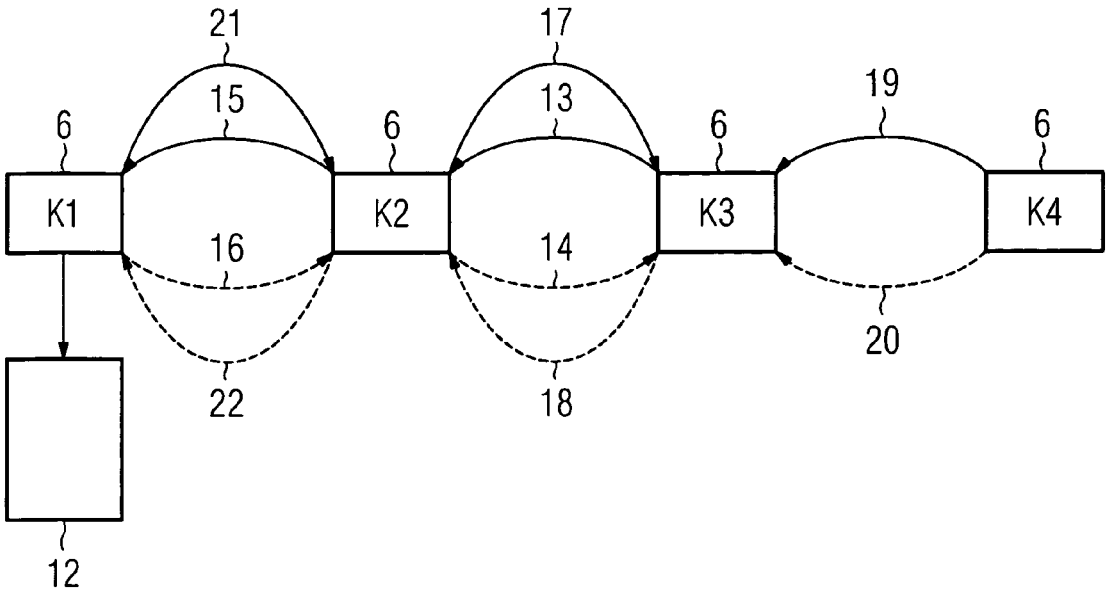
FIG. 2 shows a schematic illustration of several connected devices according to FIG. 1.

FIG. 2 is a schematic diagram of an exemplary railway system with four devices 61, 62, 63, 64, which are connected with each other in the manner depicted in FIG. 1. Data between the devices 61, 62, 63, 64 are exchanged via two directly adjacent devices, such as devices 61 and 62, by way of the safety devices or transceivers 61*a*, 61*b*, 62*a*, 62*b*, 63*a*, 63*b* (FIG. 1) that are connected with the rail 2*a*, 2*b* of a corresponding track section 1, as described above.

The data typically includes data for safely controlling the railway signaling devices 51, 52, 53 and additional data, such as message data and/or command data.

Unlike to the data for safely controlling the railway signaling devices 51, 52, 53, the message data and command data are transmitted with the identifier K (K1, K2, K3, K4) of one of the originating devices 61, 62, 63, 64, useful information, and an identifier K (K1, K2, K3, K4) of the destination device 61, 62, 63, 64. The information is encoded to correspond to the respective message or command to be transmitted.

FIG. 2 shows the device 61 which has the identifier K1 being connected to a fault reporting center 12 which receives the messages.

The transmission of message data from the device 63 with the identifier K3 to the fault reporting center 12 will now be described. The device 63 with the identifier K3 transmits the message data initially on the path 13 to the device 62 with the identifier K2, because the device 62 is located in the direction of the target device 61 with the identifier K1, thus being the device directly following device 63 in this direction. The device 62 receives, stores and returns the received message data to the device 63 via the path 14. The originating device 63 with the identifier K3 then compares the returned data with the originally transmitted data and confirms agreement between the originally transmitted and returned data by ceasing transmission of the message data. If the data to not agree, the message data is forwarded to the device 62 with the identifier K2 until the originally transmitted and returned data agree. After agreement is confirmed, the device 62 with the identifier K2 forwards the message data to the device 61 with the identifier K1 (path 15). Device 61 receives, stores and returns the data to the safety device 62 with the identifier K2, which also ceases to transmit the message data if the two message data agree. The safety device 61 with the identifier K1 is identical with the destination safety device 61. Therefore, the device 61 with the identifier K1 forwards the message data to the fault reporting center 12.

If, in another situation, device 62 with the identifier K2 were to send the message data to the device 64 with the identifier K4, then the transmission occurs likewise on the path 17, with the data being returned on the path 18. After agreement between the data is confirmed, as before, the message data are subsequently transmitted from the device 63 with the identifier K3 via the paths 19, 20 to the device 64 and acknowledged.

Moreover, a command can be sent, for example to the device 63 with the identifier K3, from a command center, from the fault reporting location 12 or from one of the devices 61, 62, 63, 64, for example, whereby the command data are forwarded in a similar manner as the message data.

Figure 3:
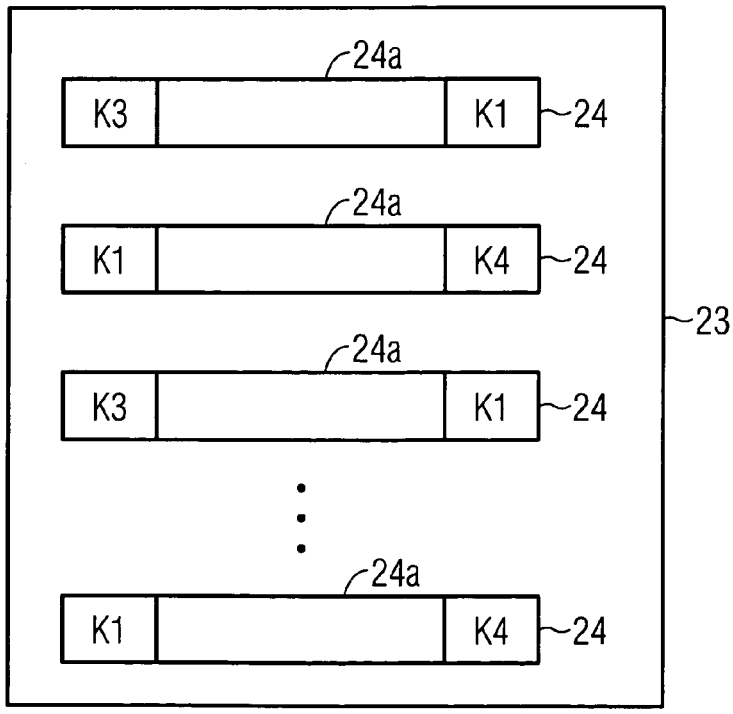
FIG. 3 shows a memory stack with message data and/or command data.

FIG. 3 shows schematically a memory stack 23, which stores, for example buffers, the message data and/or command data 24 in the devices 61, 62, 63, 64. The target identifier K1, . . . , K4 of the target device 61, . . . , 64, on the left side, the actual message code 24*a* in the center, and the identifier K1, . . . , K4 of the originating device 61, . . . , 64 on the right side. Each device 61, . . . , 64 can include a respective memory stack 23. This is advantageous, in particular, because message data and/or command data 24 have a lesser transmission priority than the data for safely controlling the signaling devices 51, 52, . . .

The transmit and receive cycles have a logical structure consisting each of a predetermined number of time intervals, and can be lengthened for increasing the number of transmittable codes 24*a* in the transmission of the message data and/or command data 24. The message data and/or command data 24 and the data for safety controlling the railway signaling devices 51, 52, can also be transmitted in alternating time slots. The message data and/or the command data 24 can also include an identification pulse, which can be within a cycle time the first signal pulse of an electrical signal, and can have a negative or positive polarity independent of the polarity of the following signal pulse.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A railway system, comprising at least one track with at least two rails, a plurality of railway signaling devices for controlling track-bound vehicles moving along the rails, and a plurality of safety devices associated with the railway signaling devices in one-to-one correspondence and each having a unique identifier, with two directly adjacent safety devices exchanging data bidirectionally via the rails, wherein the data are exchanged sequentially step-by-step in alternating transmit and receive cycles, wherein a portion of the data includes an identifier of an originating one of the plurality of safety devices, useful information, and an identifier of a destination one of the plurality of safety devices, wherein when the data are forwarded, a respective first of the plurality of safety devices transmits the data to a directly following second of the plurality of safety devices in the direction of the destination safety device, with the second safety device receiving the data, storing the data and returning the data to the first safety device, and wherein the first safety device compares the returned data with the originally transmitted data and confirms to the second safety device agreement between the originally transmitted and the returned data.

2. The railway system of claim 1, wherein the data include message data, in particular fault messages, or command data, or both, and wherein the useful information is included in the data as a message code or a command code.

3. The railway system of claim 2, wherein the first safety device confirms the agreement between the originally transmitted and returned message data or command data, or both, by ceasing transmission of the message data or command data.

4. The railway system of claim 2, further comprising a memory stack associated with the respective safety devices for buffering the message data or command data.

5. A method for forwarding data in a railway system from an originating safety device to a destination safety device for controlling track-bound vehicles moving on rails, the method comprising the steps of:

exchanging data bidirectionally between the safety devices via the rails, wherein the safety devices have a unique identifier and data between the safety devices are exchanged sequentially step-by-step in alternating transmit and receive cycles, with a portion of the data including the identifier of the originating safety device, useful information, and the identifier of the destination safety device, transmitting the data from a first of the safety devices to a directly following second safety device in the direction of the destination safety device, receiving the data at the second safety device, storing the data and returning the data to the first safety device, and comparing the returned data at the first safety device with the originally transmitted data and confirming to the second safety device agreement between the originally transmitted and the returned data.

6. The method of claim 5, wherein the data include message data, in particular fault messages, or command data, or both, and wherein the useful information is included in the data as a message code or a command code.

7. The method of claim 6, wherein the first safety device confirms the agreement between the originally transmitted and returned message data or command data, or both, by ceasing transmission of the message data or command data.

* * * * *